US006283842B1

(12) United States Patent
Collins

(10) Patent No.: US 6,283,842 B1
(45) Date of Patent: Sep. 4, 2001

(54) SANDING APPARATUS

(76) Inventor: John William Collins, The Barn, Mill Lane, Castleton, Cardiff, CF3 8UT (GB)

( * ) Notice: Subject to any disclaimer, the term of this patent is extended or adjusted under 35 U.S.C. 154(b) by 0 days.

(21) Appl. No.: 09/647,689

(22) PCT Filed: Apr. 1, 1999

(86) PCT No.: PCT/GB99/00860

§ 371 Date: Oct. 3, 2000

§ 102(e) Date: Oct. 3, 2000

(87) PCT Pub. No.: WO99/51402

PCT Pub. Date: Oct. 14, 1999

(30) Foreign Application Priority Data

Apr. 3, 1998 (GB) ..... 9807090
Nov. 7, 1998 (GB) ..... 9824356

(51) Int. Cl.[7] ..... B24D 17/00
(52) U.S. Cl. ..... 451/495; 451/523
(58) Field of Search ..... 451/523, 524, 451/514, 495, 913, 28, 66, 540, 557, 558

(56) References Cited

U.S. PATENT DOCUMENTS

| | | | | |
|---|---|---|---|---|
| 470,794 | * | 3/1892 | Shempp | 451/523 |
| 1,062,214 | * | 5/1913 | Bergman | 451/495 |
| 1,570,177 | * | 1/1926 | Pointer | 451/495 |
| 4,206,574 | * | 6/1980 | Dotsko | 451/495 |

FOREIGN PATENT DOCUMENTS

| | | |
|---|---|---|
| 3808138 A1 | 10/1989 | (DE) . |
| 02139177 | 5/1990 | (EP) . |
| 0 635 335 A1 | 1/1995 | (EP) . |
| 2 256 383 A | 12/1992 | (GB) . |

* cited by examiner

*Primary Examiner*—Derris H. Banks
(74) *Attorney, Agent, or Firm*—Young & Thompson

(57) ABSTRACT

A sanding apparatus includes a plurality of sheet elements with exposed, abrasive edges. These sheet elements are biased outwardly with respect to the housing by a compressible foam block. The exposed abrasive edges together define a conformable abrasive surface for sanding moldings and the like. The plurality of sheet elements may include a replaceable cassette.

18 Claims, 5 Drawing Sheets

SANDING APPARATUS

BACKGROUND OF THE INVENTION

This invention relates to sanding apparatus for sanding flat surfaces and profiles such as architraves.

The fine detail and curvatures of such profiles make them awkward to sand, either manually or by machine. Where cost has not been an important factor it has been known to make a complementary or negative profile and then to use this as a sanding block to push a sheet of sand-paper into contact with the profile to be sanded. However this is not practical or economically realistic in most cases. Alternatively, the sand-paper may be folded to allow it to reach the bottom of the grooves in the profile, but this is time consuming and not particularly effective There is therefore a need for a sanding apparatus which facilitates sanding of a profile, for example prior to painting.

DESCRIPTION OF THE RELATED ART

British Published Patent Application 2 256 383A discloses an arrangement in which a number of sheets are mounted in a block. The sheets are moveable during an adjustment phase to allow them to shift relative to each other to conform to a required profile, whereafter the sheets are locked in this position by a clamp. There is also mention of a system in which the sheets are replaced by a deformable material and also an arrangement in which the sheets are made of a rubber type material. There is however no mention of an arrangement in which a number of parallel sheet elements are mounted side by side for relative movement against a resilient bias.

SUMMARY OF THE INVENTION

Accordingly, in one aspects this invention provides a sanding apparatus for sanding a profile such as an architrave, which apparatus comprises a main body portion, a plurality of parallel sheet elements mounted side by side in said body portion for relative movement to each other and said body portion against a resilient bias, with respective exposed edges of said sheet elements together defining a conformable abrasive surface.

The exposed edges of said sheet elements each define abrasive edge surfaces. Thus the sheets may carry an abrasive coating on the exposed edges or they may be made of a suitable matrix material such as a plastics or other tough but abradable material, incorporating abrasive particles.

The exposed edges are preferably rounded in cross-section instead of having sharp 90° edges, to reduce the possibility of producing a striped effect.

The lengths of the exposed edges of the sheet elements are preferably selected such that together they define a wedge shaped leading region to the abrasive surface when it is viewed in plan.

Preferably, said sheet elements are slidably received in an aperture in said main body portion. Said bias means may take many forms. In one particular arrangement, the bias means may comprise an element of resiliently compressible material such as a foam or sponge synthetic material in block or any other suitable form. Alternatively, the bias means may comprise a first elastically deformable component, for example of a foam or sponge material, and a load-spreading or equalising component such as a fluid or gel-filled sac, which acts to distribute the contact pressure substantially evenly between the sheet elements. In another arrangement, the load-spreading or equalising component may comprise a number of loose packed rods or rod-like elements capable of shifting with respect to each other to substantially equalise the pressure applied to the sheet elements.

The sanding apparatus may be designed for manual use or adapted for use with a power tool. In this latter embodiment, the apparatus and/or tool preferably includes means for oscillating said apparatus in a direction generally parallel to the direction of said sheet elements. For example, a power tool may include an outer guide element within which the main body portion is constrained to slide back and forth but not side to side. The body portion may be driven back and forth by a reciprocating mechanism similar to that used in a powered jigsaw, although many other mechanisms could be used.

In one embodiment of a power tool of this sort, the alternate sheets may be reciprocally driven in common, in antiphase to the intermediate sheets, to provide a dynamically balanced arrangement which ensures that a major portion of the vibratory effect is applied to the abrasive surface/workpiece interface with minimal vibrational energy being transmitted to the hand or structure supporting the tool.

Whilst the invention has been described above, it extends to any inventive combination of the features set out above or in the following description.

BRIEF DESCRIPTION OF THE DRAWINGS

The invention may be formed in various ways, and, by way of example only, an embodiment thereof will now be described in detail, reference being made to the accompanying drawings, in which.

DESCRIPTION OF THE PREFERRED EMBODIMENTS

Figure 1:
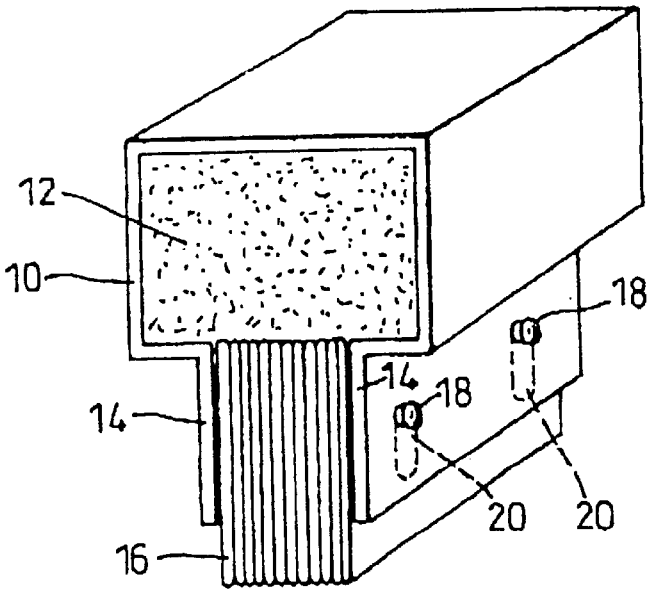
FIG. 1 is a schematic general perspective view of a sanding apparatus of this invention.

Referring to FIG. 1, the sanding apparatus comprises a main body portion 10 defining an internal chamber which is filled with a block of compressible foam or rubber material and has two depending side plates 14. Between the side plates 14 slidably mounted a stack of relatively slidable sheet elements 16. The sheet elements 16 are retained, and their extent of movement controlled, by means of two pins 18 which extend between the side plates 14 through respective slots 20 in the sheet elements 16. The lower edges of the sheet elements are rounded and either coated with or incorporate an abrasive material.

Figure 2:
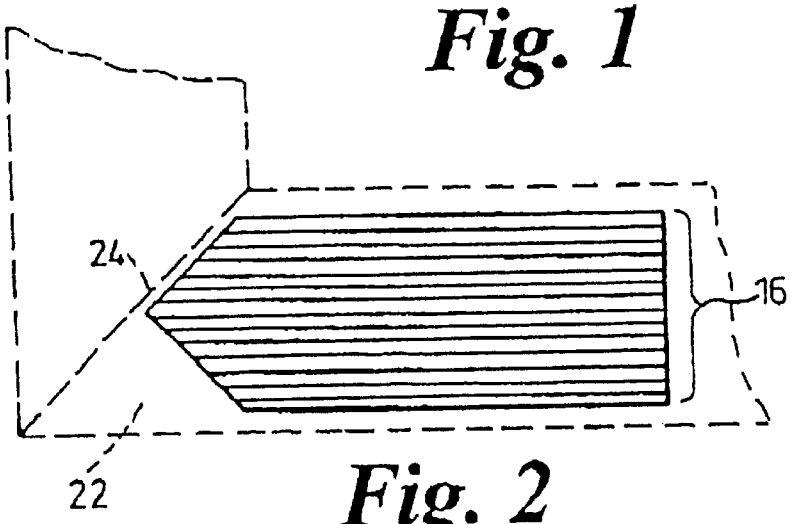
FIG. 2 is an underplan view of the conformable abrasive surface of the sanding apparatus of FIG. 1.

The lengths of the sheet elements are profiled, as seen in FIG. 2, so that the abrasive surface defined by the edges of the sheet elements 16 has a wedge shaped leading edge region. This is to facilitate sanding of a mitred frame 22 up to the mitre joint line 24 (shown in dotted lines).

Figure 3:
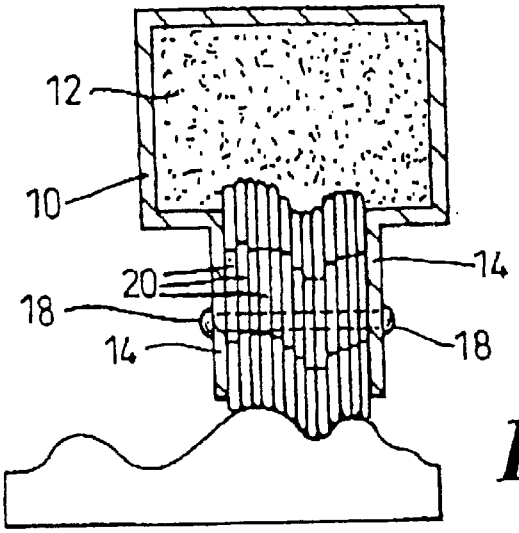
FIG. 3 shows the apparatus of FIG. 1 when applied to a typical moulded profile.

In use, the apparatus is applied to a profile and, as seen in FIG. 3, the sheet elements retract against the bias of the spring or foam block 12 to conform closely to the profile. The profile may then be sanded by moving it back and forth. The sheet elements preferably can flex slightly to accommodate slight misalignment.

Figure 4:
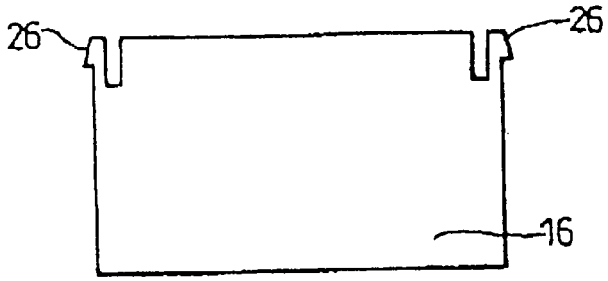
FIG. 4 shows an alternative form of sheet element for use in the sanding apparatus.

Referring to FIG. 4, an alternative form of sheet element 16 is formed with integral spring retention tags 26 which obviate the need for the pins 18 and slots 20. In use the tags 26 hook behind a ledge or abutment inside the body portion 10 to retain the sheet element.

Figure 5:
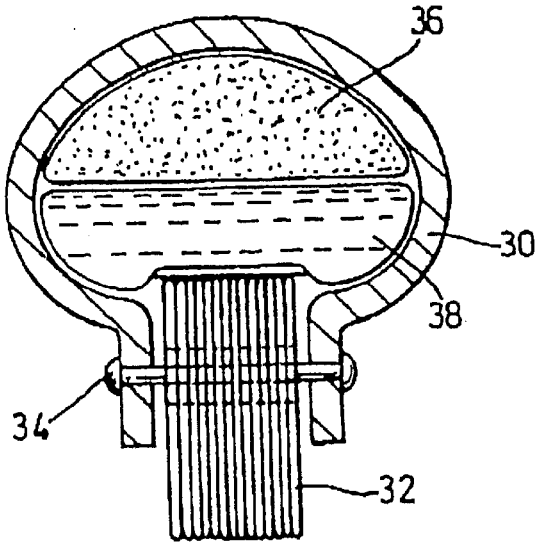
FIG. 5 is a schematic section view of another embodiment of sanding apparatus of this invention.
Figure 6:
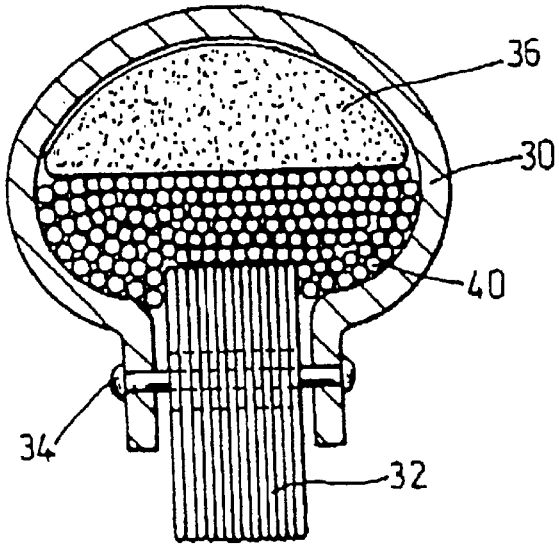
FIG. 6 is a schematic section view of a further embodiment of sanding apparatus of this invention.

Referring now to FIGS. 5 and 6, as previously the sanding apparatus comprises a housing 30 with a number of parallel sheet elements 32 with exposed abrasive edges and located for limited relative sliding movement by means of two pins (only one of which is shown) locating in aligned slots of the sheet elements 32 to allow relative sliding movement. In the upper part of the housing 30 is provided a resilient foam block 36 which is elastically deformable. In a lower part of the housing, and contacting the upper edges of the sheet elements, is a load-spreading component. In FIG. 5 the component is in the form of a fluid or gel filled sac 38, for example filled with a silicone plastics material. In FIG. 6, the load-spreading component comprises a number of loose packed rods 40 which can roll and slide with respect to each other.

In both FIGS. 5 and 6, the foam block provides a resilient force whereas the gel sac 38 or the rods 40 spread the load across the tops of the sheet elements so that the contact pressure between the exposed abrasive edge of the sheet element and the workpiece is generally constant.

In use, as with the earlier embodiment, the sheet elements are free to slide with respect to each other and thus to adjust to follow changes in profile.

Figure 7:
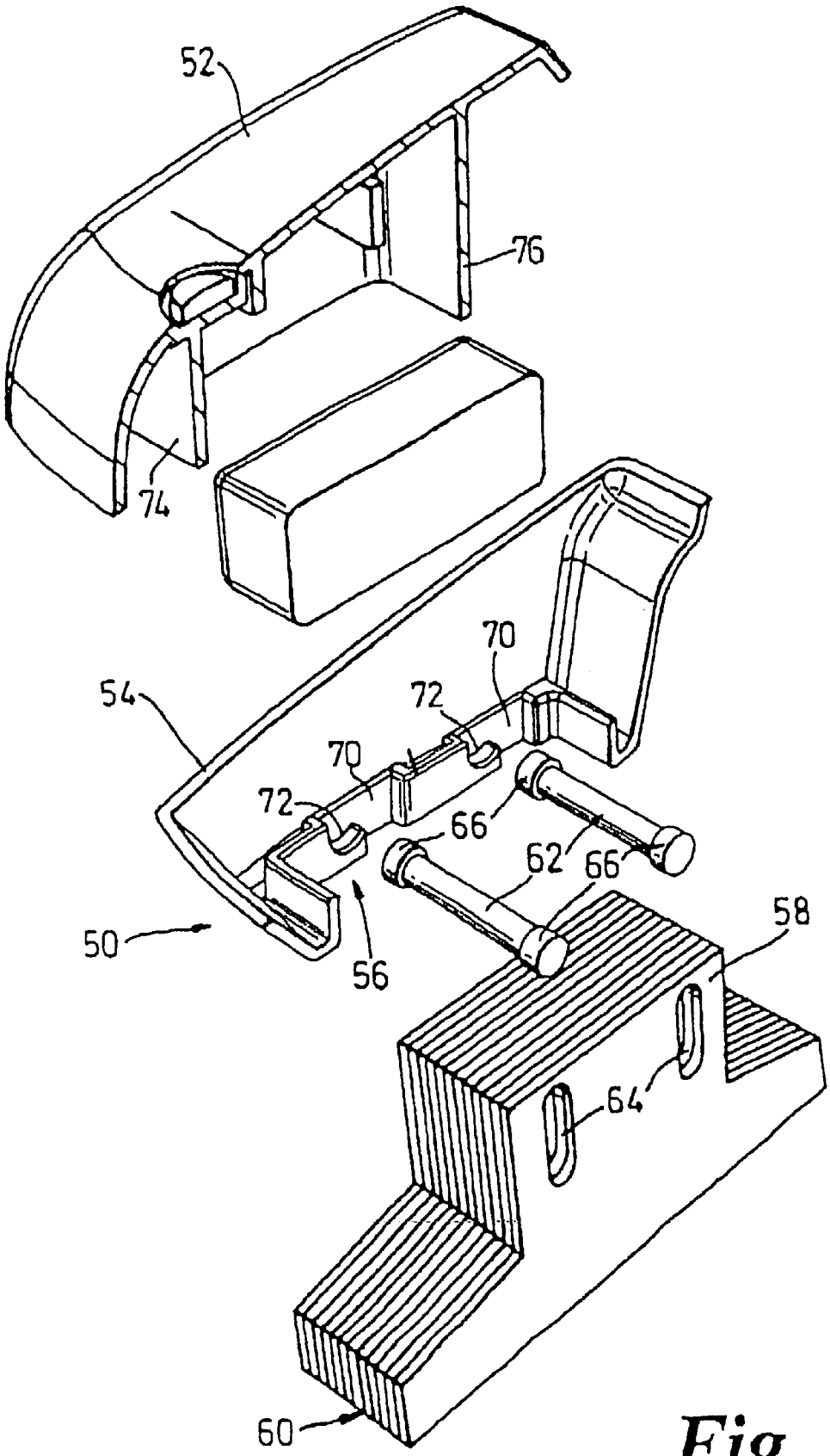
FIG. 7 is an exploded, part-sectioned perspective view of a further embodiment of sanding apparatus of this invent ion.
Figure 8:
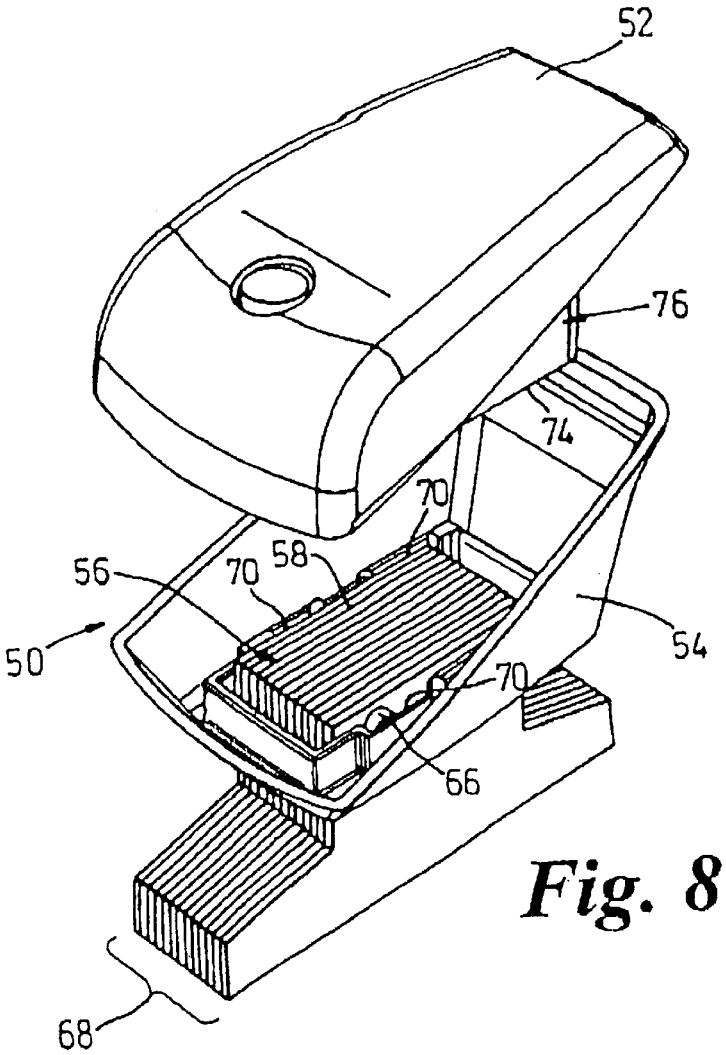
FIG. 8 is a perspective view of the further embodiment of FIG. 7, part-assembled.

Referring now to FIGS. 7 and 8, the third embodiment of the invention is of broadly similar construction to the previous embodiments. Here the tool 50 is formed of a two part casing comprising a top moulding 52 and a lower moulding 54. The lower moulding is provided with generally vertical walls defining a generally rectangular aperture 56, which receives the stems 58 of a stack of generally T-shaped sheet elements 60. The stack of sheet elements 60 are releasably and slidably located with respect to the lower moulding by means of a pair of pins 62 which pass through aligned pairs of parallel slots 64 in the sheet elements. The pins have enlarged heads 66 larger in diameter than the width of the slots which retain them in the slots to provide a replaceable "cassette" 68 comprising the sheet elements and the pins, which can be replaced when required, for example where a finer or coarser grit is required, or where the sheet elements need to be replaced The cassette 68 is located within the recess by removing the top moulding 52 and offering the cassette up to the rectangular aperture 56 from below and passing the pin heads 66 along respective J-shaped channels 70 formed in the sides of the aperture 56 to be retained by a cupped ledge 72. The top moulding 52 is then re-attached, and a retention rim 74 prevents inadvertent dislodging of the pins from the ledger 72.

The top moulding 52 comprises an outer pattern which merges with the lower moulding 54, and an inner downwardly open rectangular housing 76 which provides the retention rim 74, within the housing is contained a foam or other resiliently compressible block which in use is located against the top of the sheet elements 60 to bias them downwardly.

Figure 9:
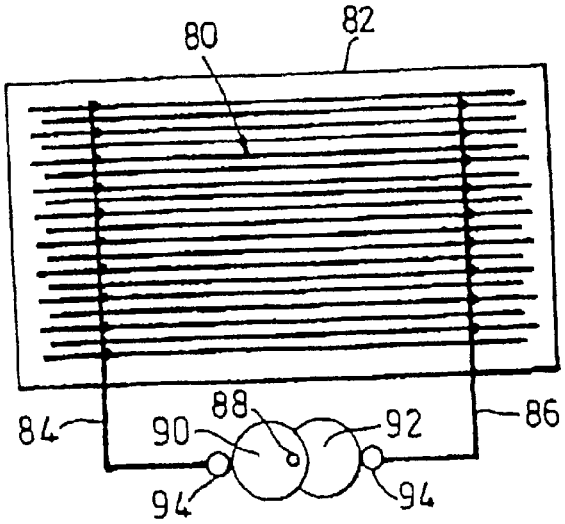
FIG. 9 is a schematic view of a powered embodiment of sanding apparatus in accordance with this invention, and FIGS. 10(*a*) (*b*) and (*c*) illustrate an alternative lapping or staggered arrangement and sheet elements for use in embodiments of the sanding apparatus of this invention.
Figure 10B:
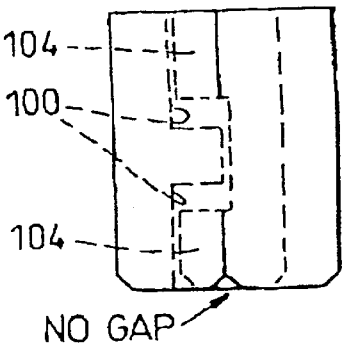
Figure 10C:
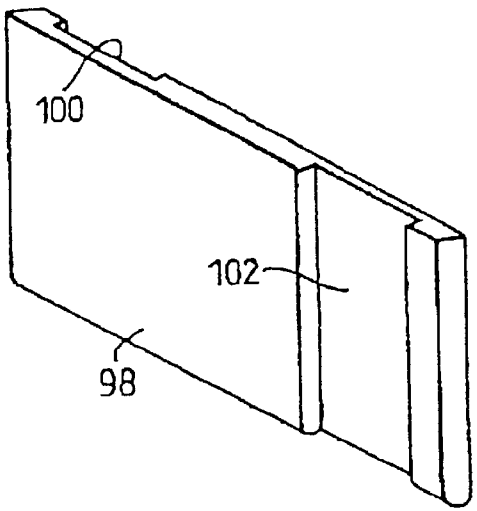
Figure 10C:
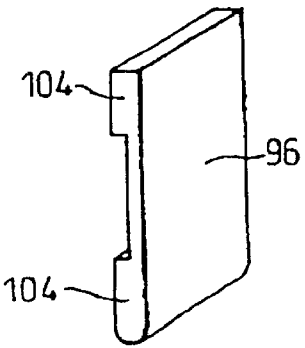
Figure 10C:
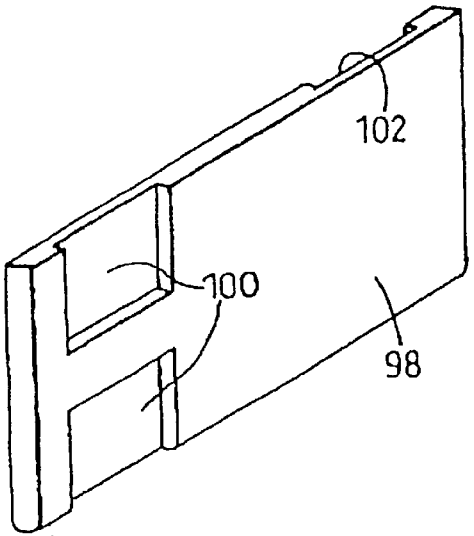
Figure 10A:
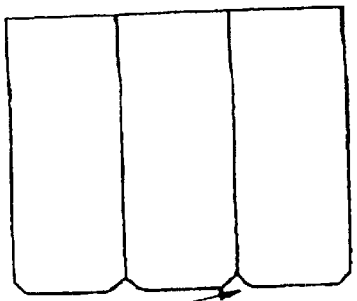

Referring now to FIG. 9, this shows schematically a powered version of the sanding tool. As previously, the sheet elements 80 are slidably mounted in a housing 82 and resiliently biassed towards the workpiece and these features will not be described in detail again. But here the sheet elements are driven reciprocally within the housing. The sheet elements could all be driven in unison but to provide dynamic balancing in this arrangement one set of alternate sheet elements 80 is connected to one drive arm 84 and the intermediate sheet elements 80 are connected to another drive arm 86. The drive arms are driven in antiphase by a stepped eccentric drive shaft 88 which provides two longitudinally spaced eccentric surfaces 90, 92 which are 180° out of phase, and which drive the arms 84 and 86 by means of cam followers 94.

Referring now to FIGS. 10(*a*), (*b*) and (*c*), in the arrangements of sheet elements described above there are slight gaps between the adjacent rounded portions of the sheet elements, as shown in FIG. 10(*a*). In many cases this will not matter greatly as there is likely to be some lateral movement of the sheets during sanding, to prevent small ridges forming. If however this is perceived as a problem a lapped arrangement of sheet elements may be provided so that, when seen in end view in FIG. 10(*b*) there is an intermediate or bridging sheet 96 between the main sheet elements 98. For this arrangement the main sheet elements 98 include on one side a spaced pair of recesses 100 and on the other a plain channel 102 extending through the depth of the main sheet element. The main sheet elements are positioned so that the plain channel and stepped recesses face each other and sandwich the bridging sheet 96 which has a channel defined by two lands 104 which limit movement of the bridging sheet to prevent it falling out. The main sheet elements and the bridging sheet elements are all biassed downwardly by a resilient foam block or the like.

What is claimed is:

1. A sanding apparatus for sanding a profile such as an architrave, which apparatus comprises:

a main body portion, and a plurality of parallel sheet elements mounted side by side in said body portion for relative movement to each other and to said body portion against a resilient bias, wherein exposed edges of said sheet elements each comprise abrasive edge surfaces, thereby together defining a conformable abrasive surface.

2. Apparatus according to claim 1, wherein the sheet elements carry an abrasive coating on the exposed edges.

3. Apparatus according to claim 1, wherein the sheet elements are made of a matrix material incorporating abrasive particles.

4. Apparatus according to claim 1, wherein the exposed edges are generally rounded in cross-section.

5. Apparatus according to claim 1, wherein sheet elements are selected such that together they define a wedge shaped leading region to the abrasive surface when viewed in plan.

6. Apparatus according to claim 1, wherein said sheet elements are slidably received in an aperture in said main body portion.

7. Apparatus according to claim 1, wherein the bias comprises an element of resiliently compressible material.

8. Apparatus according to claim 1, wherein the bias comprises an elastically deformable component and a load-spreading or equalizing component which acts to distribute a contact pressure between the sheet elements.

9. Apparatus according to claim 8, wherein said load-spreading or equalising component comprises a fluid or gel-filled sac.

10. Apparatus according to claim 8, wherein the load-spreading or equalising component comprises a plurality of loose packed rods or rod-like elements capable of shifting with respect to each other to distribute the pressure applied to the sheet elements.

11. Apparatus according to claim 1, wherein said main body portion comprises upper and lower parts releasably connected together, and said plurality of sheet elements are releasably retained in the lower part thereof.

12. Apparatus according to claim 11, wherein said upper and lower parts cooperate to retain said plurality of sheet elements in said body portion in use.

13. Apparatus according to claim 1, wherein said sheet elements include one or more aligned slots and said apparatus includes a respective elongate member passing through the or each slot.

14. Apparatus according to claim 13, wherein said elongate member or members include means for retaining said sheet elements whereby said sheet elements and said elongate member or members form a replaceable sub-assembly.

15. A replaceable sub-assembly for apparatus according to claim 1, comprising a plurality of sheet elements having exposed abrasive edge regions together defining an abrasive surface.

16. Apparatus according to claim 1 including means for oscillating said sheet elements with a least a major component generally parallel to said exposed edges, to effect a sanding operation.

17. Apparatus according to claim 16, wherein said oscillating means includes means for driving at least some of said sheet elements substantially in anti-phase.

18. Apparatus according to claim 1, wherein said sheet elements include bridging elements, having exposed abrasive edges and adapted to present the abrasive edges intermediate the edges of the main sheet elements.

* * * * *